US008074987B2

(12) United States Patent
Soltys

(10) Patent No.: US 8,074,987 B2
(45) Date of Patent: Dec. 13, 2011

(54) SYSTEMS AND METHODS FOR PROCESSING PLAYING CARDS COLLECTED FROM A GAMING TABLE

(75) Inventor: Richard Soltys, Mercer Island, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 935 days.

(21) Appl. No.: 11/352,416

(22) Filed: Feb. 10, 2006

(65) Prior Publication Data

US 2006/0205519 A1 Sep. 14, 2006

Related U.S. Application Data

(60) Provisional application No. 60/652,115, filed on Feb. 10, 2005.

(51) Int. Cl.
*A63F 1/12* (2006.01)

(52) U.S. Cl. ..... 273/149 R

(58) Field of Classification Search ..... 273/149 R, 273/148 R; 463/16, 22
See application file for complete search history.

(56) References Cited

U.S. PATENT DOCUMENTS

| | | | | |
|---|---|---|---|---|
| 2,567,223 | A | 9/1951 | Maher | |
| 2,731,271 | A | 1/1956 | Brown | |
| 3,222,071 | A | 12/1965 | Lang | 273/149 |
| 3,312,473 | A | 4/1967 | Friedman et al. | 273/149 |
| 3,339,223 | A | 9/1967 | Laby | 16/105 |
| 3,377,070 | A | 4/1968 | Nottoli | 273/149 |
| 3,493,728 | A | 2/1970 | Braden, Jr. et al. | |
| 3,561,756 | A | 2/1971 | Barnett | 271/41 |
| 3,690,670 | A | 9/1972 | Cassady et al. | 273/149 P |
| 3,751,041 | A | 8/1973 | Seifert | 273/149 P |
| 3,752,962 | A | 8/1973 | Greskovics | 235/61.11 D |
| 3,814,436 | A | 6/1974 | Boren | 273/149 P |
| 3,897,954 | A | 8/1975 | Erickson et al. | 273/149 R |
| 3,907,282 | A | 9/1975 | Hunter | 271/233 |
| 3,929,339 | A | 12/1975 | Mattioli | 273/148 A |
| 3,937,311 | A | 2/1976 | Gehrke | 192/45 |
| 3,937,312 | A | 2/1976 | Gehrke | 192/45 |
| 3,942,616 | A | 3/1976 | Elmore | 192/45 |
| 3,972,573 | A | 8/1976 | Marola | 308/217 |

(Continued)

FOREIGN PATENT DOCUMENTS

DE 44 39 502 C1 9/1995

(Continued)

OTHER PUBLICATIONS

U.S. Appl. No. 11/558,409, filed Nov. 9, 2006, Soltys.

(Continued)

*Primary Examiner* — David L Lewis
*Assistant Examiner* — Eric M Thomas
(74) *Attorney, Agent, or Firm* — Seed IP Law Group PLLC

(57) ABSTRACT

A device for reading, transporting, and storing playing cards that have been collected after a card game at a gaming table. The system includes an input compartment to receive the collected playing cards, a reader, a conveyor system to transport the playing cards past the reader one at a time, an output compartment to store the collected playing cards after reading, and an elevator mechanism to raise the output compartment to the table surface. In addition, the system may include a modular erasing and printing device to erase portions of the playing cards and then print over the erased portions and/or print onto blank playing cards.

10 Claims, 6 Drawing Sheets

U.S. PATENT DOCUMENTS

| | | | | |
|---|---|---|---|---|
| 3,990,555 | A | 11/1976 | Carullo | 192/45 |
| 3,993,176 | A | 11/1976 | Marola et al. | 192/45 |
| 3,993,177 | A | 11/1976 | Gehrke | 192/45 |
| 3,994,377 | A | 11/1976 | Elmore | 192/45 |
| 4,135,663 | A | 1/1979 | Nojiri et al. | 235/463 |
| 4,241,921 | A | 12/1980 | Miller | 273/148 A |
| 4,310,160 | A | 1/1982 | Willette et al. | 273/149 R |
| 4,373,726 | A | 2/1983 | Churchill et al. | 273/138 A |
| 4,457,512 | A | 7/1984 | Stevenson | 273/148 A |
| 4,497,488 | A | 2/1985 | Plevyak et al. | 273/149 R |
| 4,512,580 | A | 4/1985 | Matviak | 273/148 A |
| 4,531,909 | A | 7/1985 | Takeshita | 432/37 |
| 4,534,562 | A | 8/1985 | Cuff et al. | 273/149 P |
| 4,586,712 | A | 5/1986 | Lorber et al. | 273/149 R |
| 4,636,846 | A | 1/1987 | Villarreal | 358/100 |
| 4,659,082 | A | 4/1987 | Greenberg | 273/149 R |
| 4,662,637 | A | 5/1987 | Pfeiffer | 273/149 P |
| 4,667,959 | A | 5/1987 | Pfeiffer et al. | 273/149 R |
| 4,693,480 | A | 9/1987 | Smith | 273/296 |
| 4,725,079 | A | 2/1988 | Koza et al. | 283/73 |
| 4,750,743 | A | 6/1988 | Nicoletti | 273/148 A |
| 4,770,421 | A | 9/1988 | Hoffman | 273/149 R |
| 4,807,884 | A | 2/1989 | Breeding | 273/149 R |
| 4,822,050 | A | 4/1989 | Normand et al. | 273/149 P |
| 4,832,341 | A | 5/1989 | Muller et al. | 273/139 |
| 4,832,342 | A | 5/1989 | Plevyak et al. | 273/149 R |
| 4,889,367 | A | 12/1989 | Miller | 283/88 |
| 4,951,950 | A | 8/1990 | Normand et al. | 273/149 P |
| 4,969,648 | A | 11/1990 | Hollinger et al. | 273/149 R |
| 4,995,615 | A | 2/1991 | Cheng | 273/292 |
| 4,998,737 | A | 3/1991 | Lamle | 273/296 |
| 5,000,453 | A | 3/1991 | Stevens et al. | 273/149 R |
| 5,053,612 | A | 10/1991 | Pielemeier et al. | 235/462 |
| 5,067,713 | A | 11/1991 | Soules et al. | 273/149 P |
| 5,096,197 | A | 3/1992 | Embury | 273/149 R |
| 5,110,134 | A | 5/1992 | Laughlin et al. | 273/293 |
| 5,114,153 | A | 5/1992 | Rosenwinkel et al. | 273/292 |
| 5,121,921 | A | 6/1992 | Friedman et al. | 273/149 P |
| 5,186,464 | A | 2/1993 | Lamle | 273/149 R |
| 5,199,710 | A * | 4/1993 | Lamle | 463/22 |
| 5,216,234 | A | 6/1993 | Bell | 235/494 |
| 5,240,140 | A | 8/1993 | Huen | 221/13 |
| 5,259,907 | A | 11/1993 | Soules et al. | 156/277 |
| 5,261,667 | A | 11/1993 | Breeding | 273/149 R |
| 5,275,411 | A | 1/1994 | Breeding | 273/149 R |
| 5,283,422 | A | 2/1994 | Storch et al. | 235/375 |
| 5,303,921 | A | 4/1994 | Breeding | 273/149 R |
| 5,319,181 | A | 6/1994 | Shellhammer et al. | 235/462 |
| 5,343,028 | A | 8/1994 | Figarella et al. | 235/462 |
| 5,344,146 | A | 9/1994 | Lee | 273/149 R |
| 5,356,145 | A | 10/1994 | Verschoor | 273/149 R |
| 5,382,024 | A | 1/1995 | Blaha | 273/149 R |
| 5,397,133 | A | 3/1995 | Penzias | 273/439 |
| 5,431,399 | A | 7/1995 | Kelley | 273/149 P |
| 5,445,377 | A | 8/1995 | Steinbach | 273/149 R |
| 5,518,249 | A | 5/1996 | Sines et al. | 273/304 |
| 5,548,110 | A | 8/1996 | Storch et al. | 235/472 |
| 5,575,475 | A | 11/1996 | Steinbach | 273/149 R |
| 5,584,483 | A | 12/1996 | Sines et al. | 273/149 R |
| 5,586,936 | A * | 12/1996 | Bennett et al. | 463/25 |
| 5,669,816 | A | 9/1997 | Garczynski et al. | 463/12 |
| 5,676,372 | A | 10/1997 | Sines et al. | 273/149 R |
| 5,683,085 | A | 11/1997 | Johnson et al. | 273/149 R |
| 5,685,543 | A | 11/1997 | Garner | 273/148 A |
| 5,690,324 | A | 11/1997 | Otomo et al. | 270/58.02 |
| 5,692,748 | A | 12/1997 | Frisco et al. | 273/149 R |
| 5,695,189 | A | 12/1997 | Breeding et al. | 273/149 R |
| 5,707,287 | A * | 1/1998 | McCrea, Jr. | 463/27 |
| 5,718,427 | A | 2/1998 | Cranford et al. | 273/149 R |
| 5,720,484 | A * | 2/1998 | Hsu | 273/292 |
| 5,780,831 | A | 7/1998 | Seo et al. | 235/462 |
| 5,791,988 | A | 8/1998 | Nomi | 463/11 |
| 5,934,866 | A | 8/1999 | Redden | 414/798.9 |
| 5,944,310 | A | 8/1999 | Johnson et al. | 273/149 R |
| 5,989,122 | A * | 11/1999 | Roblejo | 463/22 |
| 6,019,368 | A | 2/2000 | Sines et al. | 273/149 R |
| 6,042,150 | A | 3/2000 | Daley | 283/86 |
| 6,062,481 | A | 5/2000 | Storch et al. | 235/494 |
| 6,068,258 | A | 5/2000 | Breeding et al. | 273/149 R |
| 6,139,014 | A | 10/2000 | Breeding et al. | 273/149 R |
| 6,145,838 | A | 11/2000 | White | 273/295 |
| 6,149,154 | A | 11/2000 | Grauzer et al. | 273/149 R |
| 6,161,476 | A | 12/2000 | Yoneoka | 101/118 |
| 6,220,960 | B1 * | 4/2001 | Kryzhanovsky | 463/13 |
| 6,234,898 | B1 | 5/2001 | Belamant et al. | 463/25 |
| 6,250,632 | B1 | 6/2001 | Albrecht | 273/149 R |
| 6,254,096 | B1 | 7/2001 | Grauzer et al. | 273/149 R |
| 6,267,248 | B1 | 7/2001 | Johnson et al. | 209/547 |
| 6,276,267 | B1 | 8/2001 | Yoneoka | 101/114 |
| 6,293,546 | B1 | 9/2001 | Hessing et al. | 273/138.2 |
| 6,299,167 | B1 | 10/2001 | Sines et al. | 273/149 R |
| 6,299,536 | B1 * | 10/2001 | Hill | 463/47 |
| 6,325,373 | B1 | 12/2001 | Breeding et al. | 273/149 R |
| 6,361,044 | B1 | 3/2002 | Block et al. | 273/149 R |
| 6,439,425 | B1 | 8/2002 | Masek | 221/241 |
| 6,502,116 | B1 | 12/2002 | Kelly et al. | 708/250 |
| 6,543,770 | B1 | 4/2003 | Kaji et al. | 273/148 R |
| 6,561,897 | B1 | 5/2003 | Bourbour et al. | 463/13 |
| 6,568,678 | B2 | 5/2003 | Breeding et al. | 273/149 R |
| 6,588,750 | B1 | 7/2003 | Grauzer et al. | 273/149 R |
| 6,588,751 | B1 | 7/2003 | Grauzer et al. | 273/149 R |
| 6,638,161 | B2 * | 10/2003 | Soltys et al. | 463/12 |
| 6,651,981 | B2 | 11/2003 | Grauzer et al. | 273/149 R |
| 6,651,982 | B2 * | 11/2003 | Grauzer et al. | 273/149 R |
| 6,655,684 | B2 | 12/2003 | Grauzer et al. | 273/149 R |
| 6,659,460 | B2 | 12/2003 | Blaha et al. | 273/149 R |
| 6,676,127 | B2 | 1/2004 | Johnson et al. | 273/149 R |
| 6,698,756 | B1 | 3/2004 | Baker et al. | 273/149 R |
| 6,719,288 | B2 | 4/2004 | Hessing et al. | 273/149 R |
| 6,726,205 | B1 | 4/2004 | Purton | 273/148 R |
| 6,746,330 | B2 | 6/2004 | Cannon | 463/25 |
| 6,889,979 | B2 | 5/2005 | Blaha et al. | 273/149 R |
| 6,896,618 | B2 | 5/2005 | Benoy et al. | 463/25 |
| 6,912,812 | B2 | 7/2005 | Inage | 49/409 |
| 6,955,599 | B2 | 10/2005 | Bourbour et al. | 463/13 |
| 6,991,540 | B2 * | 1/2006 | Marlow | 463/16 |
| 7,011,309 | B2 | 3/2006 | Soltys et al. | 273/149 R |
| 7,073,791 | B2 | 7/2006 | Grauzer et al. | 273/149 R |
| 7,137,627 | B2 | 11/2006 | Grauzer et al. | 273/149 R |
| 7,255,344 | B2 | 8/2007 | Grauzer et al. | 273/149 R |
| 7,322,576 | B2 | 1/2008 | Grauzer et al. | 273/149 R |
| 7,338,044 | B2 | 3/2008 | Grauzer et al. | 273/149 R |
| 7,390,256 | B2 | 6/2008 | Soltys et al. | 463/12 |
| 7,510,186 | B2 | 3/2009 | Fleckenstein | 273/149 R |
| 2002/0063389 | A1 | 5/2002 | Breeding et al. | 273/292 |
| 2002/0163125 | A1 | 11/2002 | Grauzer et al. | 273/149 R |
| 2002/0187921 | A1 | 12/2002 | Rubeinstein | 463/11 |
| 2003/0036425 | A1 | 2/2003 | Kaminkow et al. | 463/25 |
| 2003/0073498 | A1 | 4/2003 | Grauzer et al. | 463/42 |
| 2003/0090059 | A1 | 5/2003 | Grauzer et al. | 273/149 R |
| 2004/0005920 | A1 | 1/2004 | Soltys et al. | 463/25 |
| 2004/0067789 | A1 | 4/2004 | Grauzer et al. | 463/11 |
| 2004/0108255 | A1 | 6/2004 | Johnson | 209/547 |
| 2004/0108654 | A1 | 6/2004 | Grauzer et al. | 273/148 R |
| 2004/0169332 | A1 | 9/2004 | Grauzer et al. | 273/149 R |
| 2004/0224777 | A1 | 11/2004 | Smith et al. | 463/47 |
| 2004/0259618 | A1 | 12/2004 | Soltys et al. | 463/11 |
| 2005/0012270 | A1 * | 1/2005 | Schubert et al. | 273/149 R |
| 2005/0023752 | A1 | 2/2005 | Grauzer et al. | 273/149 R |
| 2005/0040594 | A1 | 2/2005 | Krenn et al. | 273/149 R |
| 2005/0059479 | A1 | 3/2005 | Soltys et al. | 463/29 |
| 2005/0062227 | A1 | 3/2005 | Grauzer et al. | 273/149 R |
| 2005/0073102 | A1 | 4/2005 | Yoseloff et al. | 273/292 |
| 2005/0093230 | A1 | 5/2005 | Grauzer et al. | 273/149 R |
| 2005/0156318 | A1 | 7/2005 | Douglas | 257/761 |
| 2006/0001217 | A1 | 1/2006 | Soltys et al. | 273/292 |
| 2006/0205519 | A1 | 9/2006 | Soltys | 463/47 |
| 2006/0211481 | A1 | 9/2006 | Soltys et al. | 463/16 |
| 2007/0004500 | A1 | 1/2007 | Soltys et al. | 463/22 |
| 2008/0113781 | A1 | 5/2008 | Soltys et al. | 463/28 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118006 | A1 | 5/2009 | Kelly et al. | 463/31 |
| 2009/0170594 | A1 | 7/2009 | Delaney et al. | 463/25 |

FOREIGN PATENT DOCUMENTS

| | | | |
|---|---|---|---|
| EP | 0 327 069 | A2 | 8/1989 |
| EP | 0 790 848 | | 8/1997 |
| EP | 0 700 980 | B1 | 11/1999 |
| FR | 530732 | | 12/1921 |
| FR | 24238 | | 3/1922 |
| WO | WO 02/051512 | A2 | 7/2002 |
| WO | WO 2006/039308 | A2 | 4/2006 |

OTHER PUBLICATIONS

U.S. Appl. No. 10/885,875, filed Jul. 7, 2004, Soltys et al.
U.S. Appl. No. 10/902,436, filed Jul. 29, 2004, Soltys et al.
U.S. Appl. No. 10/962,166, filed Oct. 8, 2004, Soltys et al.
U.S. Appl. No. 11/428,240, filed Jun. 30, 2006, Fleckenstein.
U.S. Appl. No. 11/428,253, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys.
U.S. Appl. No. 11/480,273, filed Jun. 30, 2006, Soltys.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/838,280, filed Aug. 17, 2006, Soltys et al.
Burke, A., "Tracking the Tables," reprinted from *International Gaming & Wagering Business*, Aug. 2003, 4 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPBacc—Specifications/Specifications," 2 pages, Nov. 2005.
International Guild of Hospitality & Restaurant Managers, "Shuffle Master, Inc. (NasdaqNM:SHFL)," accessed Dec. 30, 2003, URL=http://hospitalityguide.com/Financial/Casinos/Shuffle.htm, 3 pages.
Plaintiffs Declaration of Lawrence Luciano in Opposition to Shuffle Master's Motion for Preliminary Injunction, *Card, LLC* v. *Shuffle Master, Inc.*, D. Nev. (No. CV-N-03-0244-ECR-(RAM)), Nov. 24, 2003.
Shuffle Master, Inc., "Shuffle Master Announces New Products; Intelligent Table System to Be Debuted at G2E," Sep. 10, 2003, 2 pages.
U.S. Appl. No. 12/113,021, filed Apr. 30, 2008, Singh et al.
U.S. Appl. No. 12/112,928, filed Apr. 30, 2008, Young et al.
U.S. Appl. No. 12/112,410, filed Apr. 30, 2008, McMahan et al.
Humble, L., *The World's Greatest Blackjack Book*, Random House, Inc., New York, 1987, p. 182.
Terdiman, D., "Who's Holding the Aces Now?", reprinted from *Wired News*, Aug. 18, 2003, 2 pages.

* cited by examiner

SYSTEMS AND METHODS FOR PROCESSING PLAYING CARDS COLLECTED FROM A GAMING TABLE

BACKGROUND OF THE INVENTION

1. Field of the Invention

This description generally relates to the field of gaming, and more particularly to systems and methods of automating table gaming, for example, games played with playing cards such as blackjack, baccarat, and poker.

2. Description of the Related Art

Existing devices store playing cards in a stack, which is supported at an angle to simultaneously expose portions of each of the playing cards. A reader images or scans an exposed portion of each of the playing cards to read one or more markings carried by the playing cards. The markings may take a variety of forms, for example the markings may take the form of standard rank and suit markings such as the ranks two-ten, Jack, Queen, King, Ace, or the suits Clubs, Hearts, Spades, Diamonds. The markings may alternatively or additionally take the form of one or more machine-readable symbols carried on a portion of the playing cards, for example, carried along one or more edges of the playing cards. One possible drawback to this approach is that adjacent playing cards may be stuck together for any number of reasons, which prevents the exposure and consequently the successful reading of the markings from all of the playing cards. Consequently, it is estimated that the read accuracy associated with these type of discard readers may be as low as approximately 80%.

SUMMARY OF THE INVENTION

In one aspect, a system operable with a gaming table includes a first card receiving compartment for placing a plurality of playing cards; a first unit located under the gaming table to receive the playing cards from the compartment, and a second, modular unit. The first unit includes a first reader to successively read each of the playing cards of the plurality of playing cards and a controllable elevator moveable to a card-loading position to receive at least some of the plurality of playing cards that have been read by the reader and further moveable to a card-accessible position above the gaming table where at least some of the playing cards within the elevator are made accessible for game play. The second, modular unit is detachably coupleable to the first unit and includes a second card receiving compartment, an erasing device, and a printing device, wherein the erasing device is operable to erase at least a portion of the playing card passing thereby and the printing device is operable to provide an amount of printed matter to the at least the erased portion of the playing card.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

Figure 1:
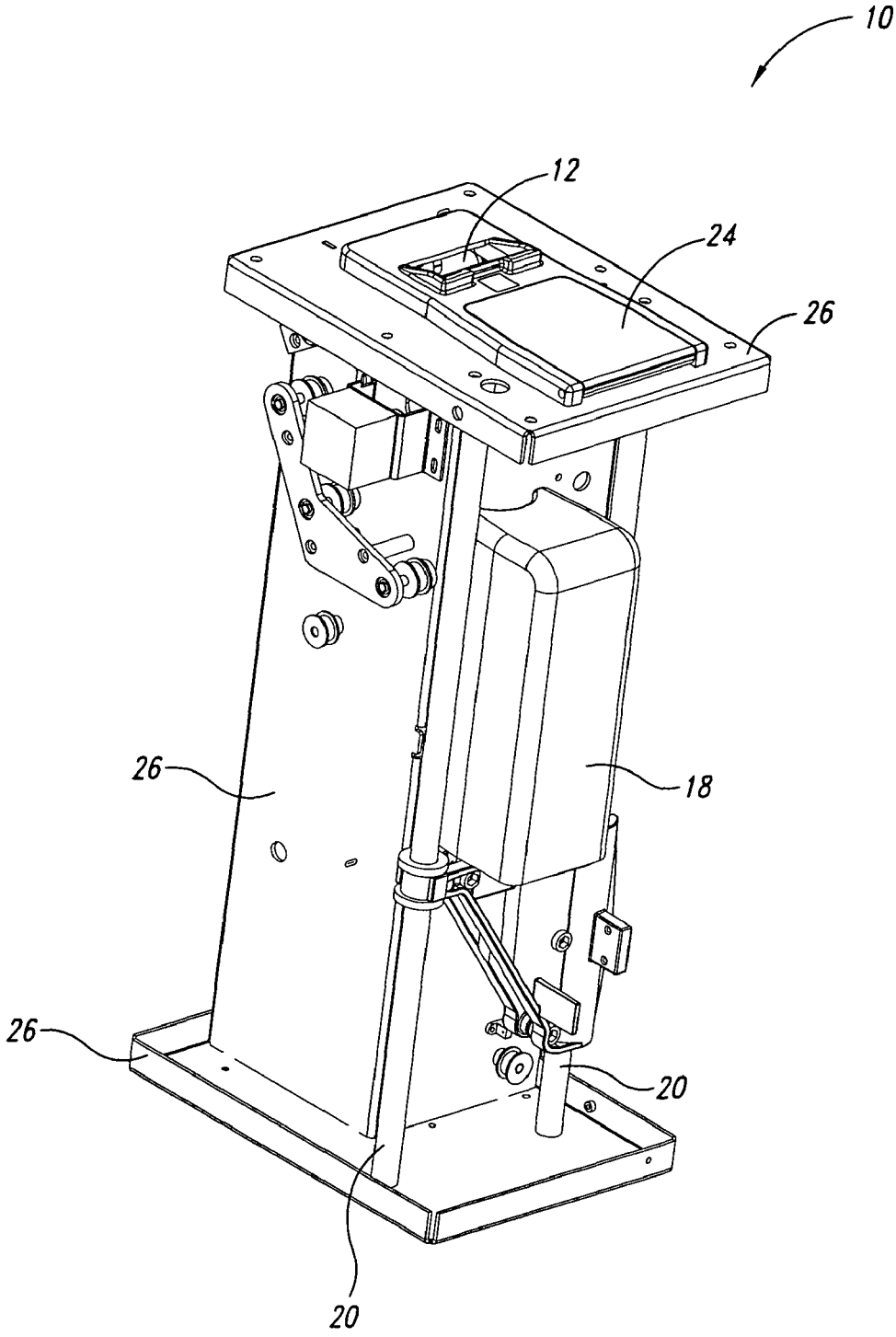
FIG. 1 is an isometric view of a system for processing playing cards collected from a gaming table, the system comprising an elevator and a card reader, according to one illustrated embodiment.
Figure 2:
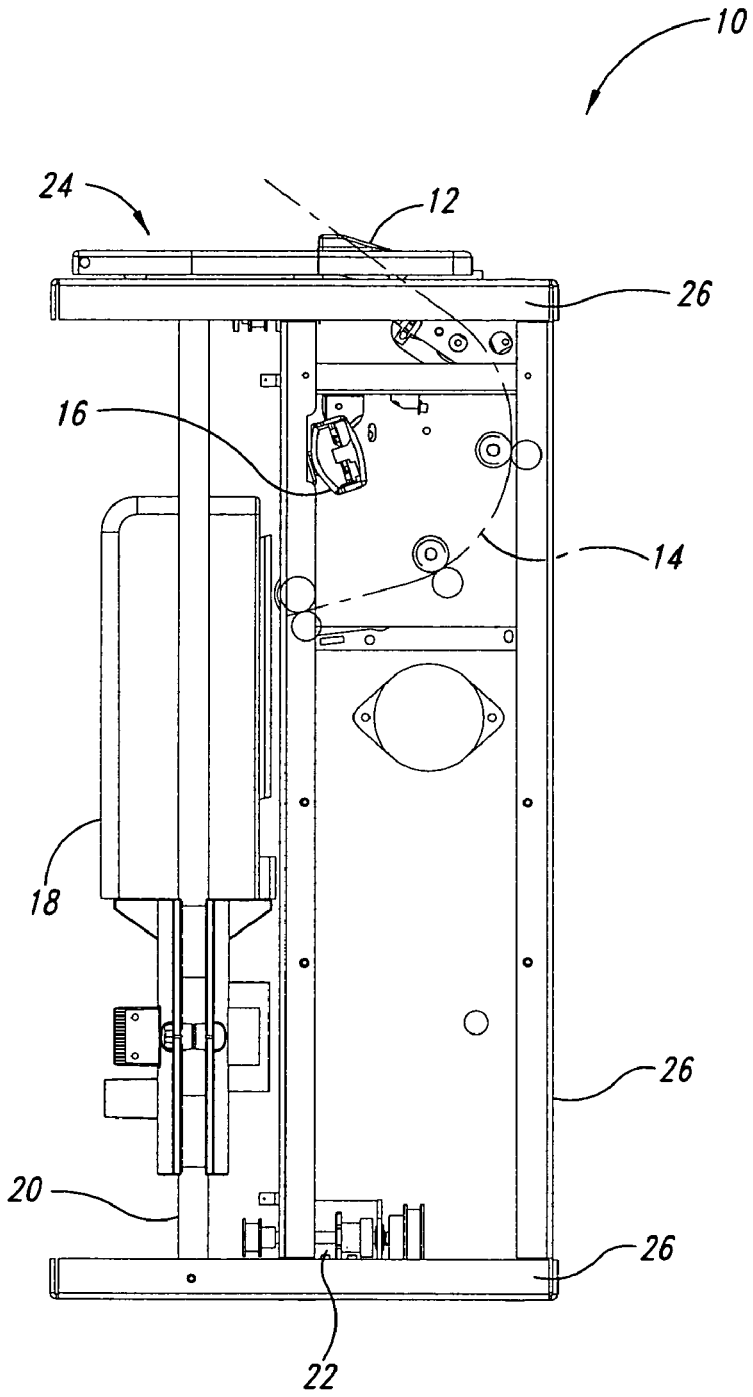
FIG. 2 is a first side view of the system of FIG. 1 showing a card reader in the system.
Figure 3:
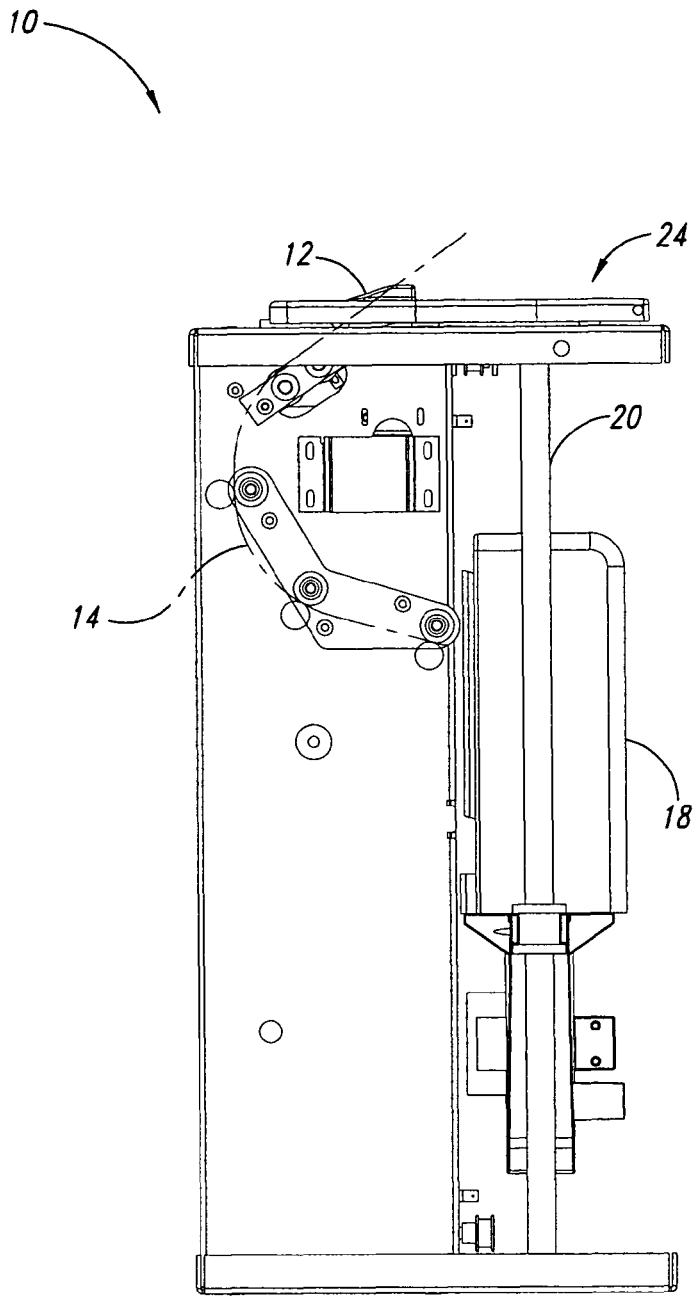
FIG. 3 is a second side view of the system of FIG. 1 showing a card path through the system.
Figure 4:
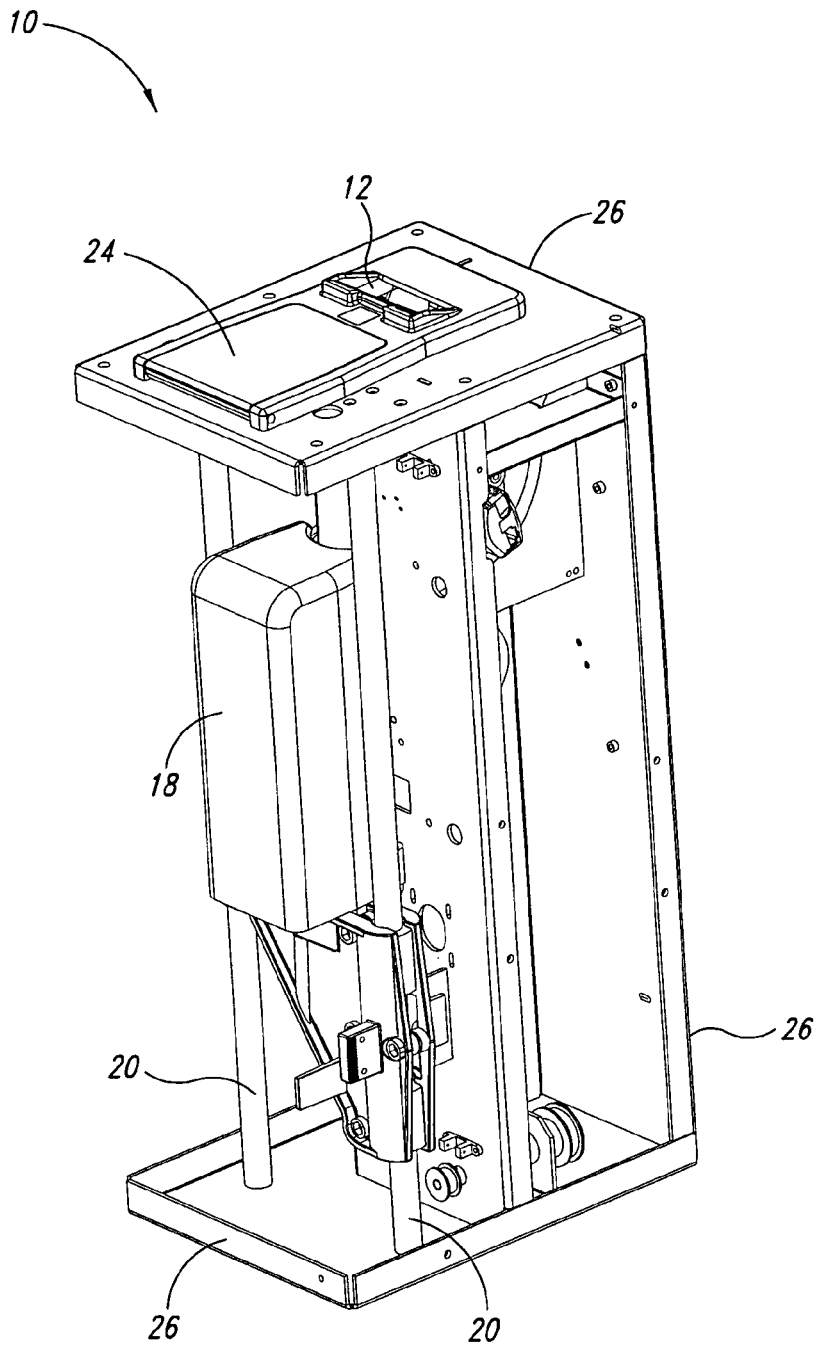
FIG. 4 is a top, right isometric view of the system of FIG. 1.
Figure 5:
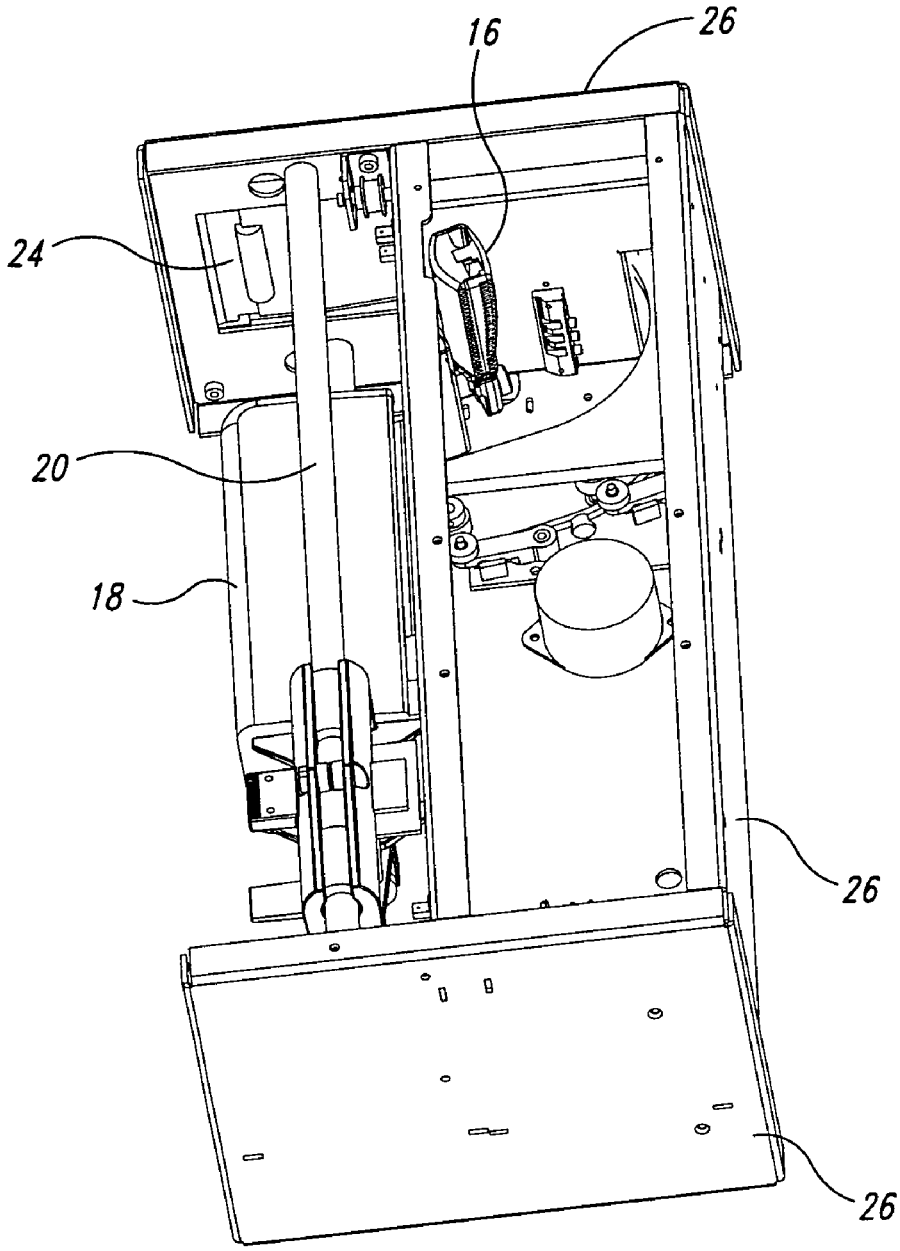
FIG. 5 is a bottom isometric view of the system of FIG. 1.

In the following description, certain specific details are set forth in order to provide a thorough understanding of various embodiments of the invention. However, one skilled in the art will understand that the invention may be practiced without these details. In other instances, well-known structures associated with computers, computer networks, readers and machine-vision have not been shown or described in detail to avoid unnecessarily obscuring descriptions of the embodiments of the invention.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the claimed invention.

FIGS. 1-5 illustrate a device 10 for reading, transporting, storing, and recycling playing cards that have been played during a game at a gaming table. The device 10 permits a number of playing cards (e.g., 30-52) to be stacked into an input compartment located on the gaming table. The playing cards placed in the input compartment are comprised of playing cards collected from the surface of the gaming table, such as those collected by the dealer from the players or dealer's ownself at the end of a game, round, or hand. It should however be understood that the playing cards placed in the input compartment can originate from anywhere. An opening 12 in the device 10 receives the playing cards from the input compartment in the gaming table.

The playing cards are directed from the input compartment along a media path via a conveyor system 14 (FIG. 2), which may employ a number of friction rollers. The conveyor system 14 may draw the cards one-by-one from the input compartment.

The playing cards carry markings, for example, machine-readable symbols such as barcode symbols. The conveyor system 14 moves the playing cards one-by-one past a reader 16 (FIG. 2) (i.e., an imager or a scanner), exposing at least a portion of each of the playing card bearing the machine-readable symbol to the reader, in turn.

In one embodiment, the reader 16 is a point scanner. In this embodiment, the machine-readable symbol may include two tracks, a first track encoding an identifier and a second track encoding timing information, allowing the reader to determine or compensate for variations in the velocity of the playing card(s) as the playing card(s) moves past the reader 16. One advantage of reading the playing cards individually is to achieve a greater read rate of the cards, as compared to current discard readers that image only a small exposed edge portion of the playing cards arranged in a sloped stack.

In one embodiment, the playing cards each have more than one machine-readable symbol. In such an embodiment, multiple readers (e.g., point scanners) or a two-dimensional imager could be used to read the multiple machine-readable symbols carried by the playing cards. Using multiple symbols can provide a more robust system 10 in the event that one of the machine-readable symbols is unreadable.

After each playing card is read by the reader 16, the conveyor system 14 directs the playing card into an output compartment, which can store up to eight decks of playing cards. An elevator mechanism 18 guides the output compartment vertically with respect to the surface of the gaming table. The input compartment may be mounted on guide shafts 20. A stepper motor 22 incrementally controls the vertical position of the output compartment 18. The stepper motor 22 is capable of moving the output compartment 18 up or down by approximately the thickness of one playing card. After a desired amount of playing cards have been placed in the output compartment or by command of the dealer, the stepper motor 22 drives the elevator 18 up through an opening 24 located in a frame 26 of the device 10, in which the opening 24 coincides with an opening in the gaming table. The elevator mechanism 18 moves all the playing cards in the output compartment above the surface of the gaming table and makes them accessible (e.g., accessible to the dealer so the dealer can remove the playing cards, and for example, shuffle the playing cards for the start of a new hand).

The information read from the playing cards can be processed through the casino computing system. For example, when a dealer collects the playing cards from the patrons in a selected order and then places the playing cards into the system 10, the information obtained from reading the cards can be used to determine a collected, discarded, or final sequence. The collected, discarded, or final sequence can be used to determine identity of playing cards forming each participant's hand, for example allowing the determination of the number and identity of hit cards taken by each player. The collected, discarded, or final sequence allows the collection of statistics, analysis of playing patterns, and recreation of the card game. A knowledge of the collected, discarded, or final sequence may be used with or without a knowledge of the starting sequence to, for example, detect cheating.

Figure 6:
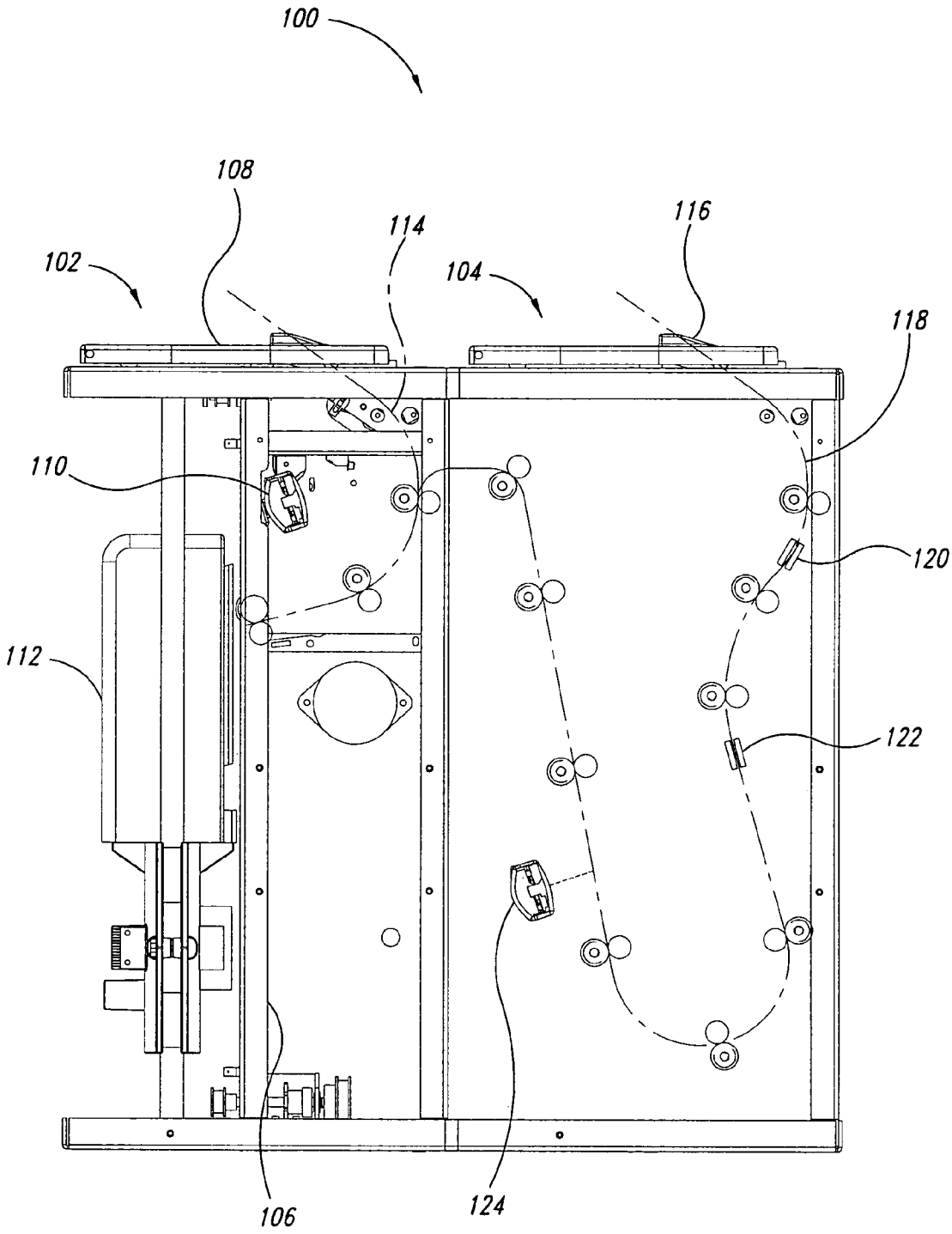
FIG. 6 is a side view of an alternative system for processing playing cards collected from a gaming table, the system includes an elevator, at least one card reader, and a modular erasing and printing device, according to one illustrated embodiment.

FIG. 6 shows a system 100 comprising a card management device 102 and a modular erasing and printing device 104. In one embodiment, the modular erasing and printing device 104 is detachable and may be of the "plug-n-play" variety. In another embodiment, the modular erasing and printing device 104 is a component or module located within a main housing 106 of the card management device 102.

The card management device 102 may be similar in form and function to the device 10 described above and in view of FIGS. 1-5. The card management device 102 includes an opening 108 to receive a first set of playing cards from the gaming table. This first set of playing cards can be successively read by a first reader 110 and directed to an elevator 112 along a first card path 114, which may comprise a conveyor system having a number of friction rollers.

The modular erasing and printing device 104 includes an opening 116 to receive a second set of playing cards. One purpose for the modular erasing and printing device 104 is to erase at least a portion of a playing card and then re-print that portion. By way of example, as the playing cards are fed into the modular erasing and printing device 104, each card is routed along a card path 118 to an erasing device 120. The erasing device 120 may be operated to erase the symbols, barcode elements, or backing designs from the second set of playing cards. In one embodiment, a special ink used on the playing cards can be activated when the special ink is exposed to a certain wavelength (e.g., infrared, ultraviolet) of light, exposed to an amount of heat, or exposed to an amount of pressure to neutralize the ink and thus create a "clean" or "bare" region on at least a portion of each playing card. Alternatively, the erasing device 120 may employ electronic reusable paper technology, which is commonly referred to as "e-paper" or "smart paper," where the card is subjected to a voltage as it passes by the erasing device 102.

The Xerox Palo Alto Research Center (PARC) developed e-paper, which comprises a thin layer of transparent plastic in which millions of small beads, somewhat like toner particles, are randomly dispersed. Each of the beads are contained in an oil-filled cavity and each bead is free to rotate within its respective cavity. The beads are "bichromal," with hemispheres of two contrasting colors (e.g. black and white, red and white), and charged so they exhibit an electrical dipole.

In the illustrated embodiment, the playing cards shall be referred to as e-cards. The erase device 120 applies a voltage to a surface of the e-card to get the beads to rotate and make one of the two possible colors visible. Voltages can be applied to the surface to create visible images such as text, symbols, or pictures. The visible image will persist until new a voltage pattern is applied. It is appreciated that there are many ways that an image can be created using e-paper technology. For example, the e-cards can be fed into the erasing device 120 where the current visible images are erased and then fed into a printing device 122 where a new voltage pattern is applied to the e-card and a substantially new e-card is created (e.g., the e-card could be quickly changed from a 2♥ to a J♠).

The printing device 122 may operate via well known printing technology, such as liquid ink jet or laser printing, which are two of the most common printing technologies existing in the present marketplace. Additionally or alternatively, the printing device 122 may operate in a manner similar to the erasing device 120 described above. In one embodiment, the printing device 122 re-activates the special ink by exposing it at an adjusted wavelength (e.g., infrared, ultraviolet) of light, an adjusted amount of heat, or an adjusted amount of pressure to generate an image on at least the "clean" or "bare" region of the playing card.

Once the playing card has been re-printed, the playing card is directed past a second reader 124. Re-printing the playing card may entail printing any portion of a front or a back of the playing card. The second reader 124 is located just after the printing device 122 in the illustrated embodiment. The second reader 122 may be a point scanner, CMOS or CCD imager, or some other type of optical reader capable of reading symbols and barcodes from a playing card.

Additionally or alternatively, the printing device 122 can sequentially print playing cards from card blanks or from previously erased cards according to a generated sequence. The newly printed or re-printed playing cards are then directed past the reader 124 where the printed matter on the playing card can be verified against a known, generated sequence and to further quality check the playing card to insure that the printed symbols and machine-readable symbols are readable. Generated sequences can be produced and the appropriate cards printed for each hand, for an entire deck of fifty-two playing cards, for a number of decks, or for any number of cards. One advantage of the printing device 122 is that the system 100 may replace the combination of a card shoe, an automatic shuffler, and a discard reader. In the game of Baccarat, for example, where the playing cards are routinely disposed of after only one hand of game play, these cards instead may be fed into the modular erasing and printing device 104 of the system 100 and be re-used for later-played hands. By reusing the playing cards, the casino may be able to save money by having to purchase fewer decks of playing cards and may be able to reduce their inventory of decks of playing cards.

Advantages

The reader 16 of the system 10 provides for an improved read accuracy of the playing cards by selectively moving the playing cards past the reader 16, one-by-one. The reader can be set to read one edge of the playing card or several edges of the playing card. This latter approach provides redundancy in reading the machine-readable symbol, which increases the accuracy.

Another advantage is that friction rollers are used to selectively route the playing cards past the optical reader, one-by-one. The friction rollers have the ability to force one playing card to move relative to an adjacent playing card, even if there is some amount of stickiness between adjacent playing cards. Thus, this type of card feeding configuration greatly increases the likelihood that each playing card will be read and that none of the playing cards will be hidden or covered by an adjacent playing card during the reading process.

Yet another advantage is that the collected playing cards, after they have been routed to the elevator, can be commanded to the table surface and readily presented for reshuffling. The elevator further provides a clandestine method of storing the collected playing cards under the gaming table.

Another advantage is that the playing cards end up in the elevator in an ending sequence that is reversed from the starting sequence. The reversed sequence provides another means for monitoring activities at the gaming table to determine if any of the playing cards have been tampered with (e.g., removed, added, etc.).

One problem addressed by the above described approach is to make the playing cards reusable. In many casinos, playing cards are used only a few times to mitigate the chance that marked cards are being recirculated into the games. In addition, some casinos use the playing cards only once before disposing of the playing cards. Used playing cards are typically re-sorted by hand and resold as used. A large casino may use about 400,000 decks of playing cards per month. In short, hundreds of millions of barely used playing cards are discarded every year.

The system 10 provides an opportunity to make the playing cards reusable by erasing and reprinting. This process also generates playing cards with new values, thus subverting the attempts of card markers to track cards that they believed are being recycled in the casino. The system provides the ability to generate sequences of playing cards according to a predetermined set of odds because the sequence can be generated virtually and stored in the printer memory.

The various embodiments described above can be combined to provide further embodiments. All of the above U.S. Patents, patent applications, Provisional Patent Applications and publications referred to in this specification, to include, but not limited to U.S. Pat. Nos. 6,460,848; 6,712,696; 6,520,857; 6,517,436; 6,530,836; 6,579,180; 6,530,837; 6,663,490; 6,527,271; 6,579,181; 6,517,435; 6,533,662; 6,595,857; 6,533,276; 6,758,751; 6,688,979; 6,652,379; 6,685,568; 6,857,961; and U.S. patent application Ser. Nos. 10/862,222; 11/030,609; 10/756,044; 10/360,846; 10/358,999; 10/823,051; 10/934,785; 10/966,835; 10/981,132; 10/703,414; and U.S. Provisional Application No. 60/562,772 are incorporated herein by reference in their entirety. Aspects of the invention can be modified, if necessary, to employ various systems, devices and concepts of the various patents, applications and publications to provide yet further embodiments of the invention.

These and other changes can be made to the invention in light of the above-detailed description. In general, in the following claims, the terms used should not be construed to limit the invention to the specific embodiments disclosed in the specification and the claims, but should be construed to include all card reading systems and methods that operate in accordance with the claims. Accordingly, the invention is not limited by the disclosure, but instead its scope is to be determined entirely by the following claims.

I claim:

1. A system operable with a gaming table comprising:

a first card receiving compartment for placing a plurality of playing cards;

a first unit located under the gaming table to receive the playing cards from the receiving compartment, the first unit having a first reader and a controllable elevator having an elevator compartment sized to hold multiple stacked playing cards, the first reader configured to successively electronically read information on each of the playing cards of the plurality of playing cards individually as drawn one-by-one from the receiving compartment in an order in which they were placed in the receiving compartment, and the controllable elevator moveable to a card-loading position to receive at least some of the plurality of playing cards that have been read by the reader in a stacked arrangement and further moveable to a card-accessible position above the gaming table where at least some of the playing cards stacked within the elevator compartment are made accessible for game play; and a second, modular unit detachably coupleable to the first unit, the second, modular unit having a second card receiving compartment, an erasing device, and a printing device, wherein the erasing device is operable to erase at least a portion of the playing card passing thereby and the printing device is operable to provide an amount of printed matter to the at least the erased portion of the playing card.

2. The system of claim 1 wherein the first reader is a point scanner adapted to read an entire playing card bearing machine-readable symbols.

3. The system of claim 1, further comprising:

a second card reader located in the system to read playing cards coming from the printing device.

4. The system of claim 1 wherein the second reader is a point scanner.

5. The system of claim 1, further comprising:

a stepper motor to move the elevator between the card-receiving position and the card-accessible position.

6. The system of claim 1, further comprising a computing system coupled to the first unit and adapted to process the electronically read information from the playing cards to determine at least one from among a collected, discarded, and a final sequence of the collected playing cards.

7. A system for processing playing cards collected from a playing table in a selected order, comprising:

a scanner adapted to read all machine-readable symbols on each playing card drawn individually one-by-one in the selected order of the collected cards to generate electronic information therefrom;

an elevator having an elevator compartment sized to hold multiple playing cards in a stacked arrangement and adapted to move at least some of the read playing cards to a card-accessible position relative to the playing table; and a computing system coupled to the scanner and adapted to process the electronically read information to determine at least one from among a collected, discarded, and final sequence of the collected playing cards.

8. The system of claim 7 wherein the scanner is a component of a first unit having a conveyer system adapted to individually draw each playing card from the collected playing cards to maintain the selected order of the collected playing cards.

9. The system of claim 8, further comprising a second unit detachably coupled to the first unit, the second unit having a card receiving compartment, an erasing device, and a printing device, wherein the erasing device is operable to erase at least a portion of a playing card passing thereby, and the printing device is operable to provide an amount of printed matter to at least the erased portion of the playing card.

10. The system of claim 9 wherein the second unit comprises a second electronic scanner adapted to individually read all machine-readable symbols on each playing card and to generate electronic information therefrom that is received by the computing system.

* * * * *

UNITED STATES PATENT AND TRADEMARK OFFICE

CERTIFICATE OF CORRECTION

PATENT NO. : 8,074,987 B2
APPLICATION NO. : 11/352416
DATED : December 13, 2011
INVENTOR(S) : Richard Soltys It is certified that error appears in the above-identified patent and that said Letters Patent is hereby corrected as shown below:

Item (56):
"5,199,710 A* 4/1993 Lamle....463/22" should read, --5,199,710 A* 4/1993 Lamle....273/149 R--.

Signed and Sealed this
Twenty-fifth Day of September, 2012

David J. Kappos

David J. Kappos
*Director of the United States Patent and Trademark Office*